US006773664B2

(12) United States Patent
Spanjers et al.

(10) Patent No.: US 6,773,664 B2
(45) Date of Patent: Aug. 10, 2004

(54) ALUMINIUM DIE-CASTING ALLOY

(75) Inventors: Martinus Godefridus Johannes Spanjers, Leiden (NL); Desikan Sampath, Koblenz (DE); Alfred Johann Peter Haszler, Vallendar (DE)

(73) Assignees: Corus Aluminium Voerde GmbH, Voerde (DE); Corus Aluminium Walzprodukte GmbH, Koblenz (DE)

( * ) Notice: Subject to any disclaimer, the term of this patent is extended or adjusted under 35 U.S.C. 154(b) by 0 days.

(21) Appl. No.: 09/816,686

(22) Filed: Mar. 26, 2001

(65) Prior Publication Data

US 2002/0006352 A1 Jan. 17, 2002

(30) Foreign Application Priority Data

Mar. 31, 2000 (EP) ..... 00201156
Oct. 20, 2000 (EP) ..... 00203660

(51) Int. Cl.[7] ..... C22C 21/06
(52) U.S. Cl. ..... 420/541; 420/544; 420/543; 420/553
(58) Field of Search ..... 420/541, 544, 420/543, 553

(56) References Cited

U.S. PATENT DOCUMENTS 5,573,606 A 11/1996 Evans et al.
5,667,602 A 9/1997 Fang et al.
6,238,495 B1 * 5/2001 Haszler et al. ..... 148/440
2000/0050118 * 12/2001 Raynaud et al. ..... 148/439

FOREIGN PATENT DOCUMENTS

| | | | | |
|---|---|---|---|---|
| EP | 799900 A1 | * | 10/1997 | ..... C22C/21/06 |
| FR | 2731019 | | 8/1996 | |
| JP | 54-065110 A | * | 5/1979 | |
| JP | 01062435 | | 8/1989 | |
| JP | 09-003582 A | * | 1/1997 | |
| JP | 09-041064 A | * | 2/1997 | |
| JP | 09003582 | | 7/1997 | |
| JP | 09041064 | | 10/1997 | |
| WO | 9615281 | | 5/1996 | |
| WO | 9625528 | | 8/1996 | |
| WO | 9630554 | | 10/1996 | |
| WO | 0799900 | | 10/1997 | |
| WO | 9738146 | | 10/1997 | |
| WO | 99 17903 | | 4/1999 | |
| WO | 9942627 | | 8/1999 | |
| WO | 00 26020 | | 5/2000 | |

* cited by examiner

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

An aluminum-magnesium alloy for casting operations consisting of, in weight percent, Mg 2.7–6.0, Mn 0.4–1.4, Zn 0.10–1.5, Zr 0.3 max., V 0.3 max., Sc 0.3 max., Ti 0.2 max., Fe 1.0 max., Si 1.4 max., balance aluminum and inevitable impurities. The casting alloy is particularly suitable for application in die-casting operations. Further the invention relates to the method of use of the casting alloy for die-casting automotive components.

27 Claims, No Drawings

ALUMINIUM DIE-CASTING ALLOY

FIELD OF THE INVENTION

The invention relates to an aluminum-magnesium alloy for casting operations and to the use of this aluminum-magnesium alloy in casting operations, in particular in die-casting operations. Further the invention relates to the application of the AlMg casting alloy in automotive components.

BACKGROUND OF THE INVENTION

Conventional aluminum-magnesium casting alloys have many attractive properties, such as high ultimate tensile strength (>170 MPa) and elongation (>8%) with moderate yield strength (>120 MPa). However, there is a demand for aluminum cast alloys combining improved mechanical properties with a good corrosion resistance.

Some disclosures of aluminum-magnesium casting alloys found in the prior art is literature will be mentioned below.

WO-96/15281 discloses a casting alloy consisting of, in weight percent:

| | |
|---|---|
| Mg | 3.0–6.0 |
| Mn | 0.5–2.0 |
| Ti | <0.2 |
| Fe | <0.15 |
| Si | 1.4–3.5 |

balance aluminum and impurities.

The alloy may be used in a die-casting operation, and appears to be particularly suitable for use in thixocasting and rheocasting operations.

WO-96/25528 discloses a casting alloy consisting of, in weight percent:

| | |
|---|---|
| Mg | 2.5–4.5, preferably 2.7–3.0 |
| Mn | 0.2–0.6, preferably 0.2–0.6 |
| Fe | <0.6 |
| Si | <0.45 |
| Cu | <0.10 |
| Be | <0.003, preferably <0.001 |

balance aluminum and impurities.

Optionally the alloy may further comprise 0.01–0.04% Ti and/or 0.01–0.10% Zn. The alloy can be employed in die-casting operations, the alloy is capable of having a yield strength greater than or equal to 110 MPa and an elongation greater than or equal to 17%.

WO-96/30554 discloses a casting alloy consisting of, in weight percent:

| | |
|---|---|
| Mg | 2.0–5.0, preferably 2.5–4.0 |
| Mn | 0.2–1.6, preferably 0.4–0.8 |
| Zr | 0.1–0.3 |
| Fe | <1.0 |
| Si | <0.3 |

balance aluminum and impurities.

The alloy may be used in die-casting operations. The casting alloy is particularly suitable for manufacturing safety components for cars. Typical strength levels disclosed in a T5-temper are YS of 116 MPa and UTS of 219 MPa and elongation of 19%.

JP-A-09-003582 discloses an aluminum casting alloy having, in weight percent:

| | |
|---|---|
| Mg | 3.0–5.5 |
| Zn | 1.0–2.0, such that Mg/Zn-ratio is 1.5–5.5 |
| Mn | 0.05–1.0 |
| Cu | 0.05–0.8 |
| Fe | 0.10–0.8 |

balance aluminum and inevitable impurities.

The cast products have in its matrix dispersed crystallised products in a spheroidising way.

SUMMARY OF THE INVENTION

It is an object of this invention to provide an aluminum-magnesium alloy that can be used in a variety of casting operations.

It is another object of this invention to provide an aluminum-magnesium alloy ideally suited for use in die-casting operations.

It is also an object of this invention to provide improved cast products and components consisting of an improved aluminum-magnesium alloy cast members that ideally are suited for automotive applications.

It is also an object of this invention to provide an aluminum-magnesium alloy having in the as-cast condition the following minimum mechanical properties: yield strength of at least 120 MPa, a tensile strength of at least 180 MPa and an elongation of at least 7%.

According to the invention there is provided an aluminum-magnesium casting alloy, having the following composition in weight percent:

| | |
|---|---|
| Mg | 2.7–6.0 |
| Mn | 0.4–1.4 |
| Zn | 0.10–1.5 |
| Zr | 0.3 max. |
| V | 0.3 max. |
| Sc | 0.3 max. |
| Ti | 0.2 max. |
| Fe | 1.0 max. |
| Si | 1.4 max. |

balance aluminum and inevitable impurities.

DETAILED DESCRIPTION OF THE PREFERRED EMBODIMENTS

By the invention cast products or cast bodies can be provided having higher strength in combination with higher elongation. In addition these products have a good corrosion resistance and can be welded using known welding techniques for this type of casting alloys. Alloys of the present invention have also been found with a good castability, in particular in die-casting operations, and no soldering occur when using the casting alloy. The aluminum casting alloy according to the invention is capable of achieving in the as-cast condition a yield strength of more than 140 MPa, in combination with a tensile strength of more than 200 MPa and an elongation at fracture of more than 7%.

The invention also includes products made from the aluminum casting alloy set out above. Typical examples of such products are die-cast, in particular high pressure die-cast, products such as safety components, vehicle wheels, steering wheels, steering columns, airbag modules/cans, brake drums and frame members for a vehicle. The alloy is particularly suited for any application having load and impact requirements where properties of high strength and high elongation are desirable. Typical safety components for cars include structural parts for crush zones or otherwise protecting car passengers. It is known to provide one or more crush zones in a frame of a vehicle such as an automobile. The crush zones are designed to crush, or deform, in the event of a vehicle collision. The deformation of the frame absorbs energy of the collision to help protect an occupant of the vehicle. The frame may be configured to deform in a certain manner upon the application of force exceeding a predetermined amount.

The present aluminum-magnesium alloy is environmentally friendly and is readily recyclable because it does not contaminate the wrought alloy stream of recycled materials. The alloy is typically solidified into ingot-derived stock by continuous casting or semi-continuous casting into a shape suitable for remelt for casting, which shape is typically an ingot billet.

It should be mentioned here that from WO-97/38146, incorporated herein by reference, an aluminum wrought alloy is known for application as rolled sheet or plate or as an extrusion, and having a composition, in weight percent:

| | |
|---|---|
| Mg | 5.0–6.0, preferably 5.0–5.6, and more preferably 5.2–5.6 |
| Mn | >0.6–1.2, preferably 0.7–0.9 |
| Zn | 0.4–1.5 |
| Zr | 0.05–0.25 |
| Cr | 0.3 max. |
| Ti | 0.2 max. |
| Fe | 0.5 max. |
| Si | 0.5 max. |
| Cu | 0.4 max. |
| Ag | 0.4 max. |

balance Al and inevitable impurities.

The aluminum wrought alloy disclosed in this international patent application is also subject of the Aluminum Association registration number AA5069.

From WO-99-42627, incorporated herein by reference, an aluminum-magnesium alloy in the form of a rolled product or an extrusion is known, having the following composition, in weight percent:

| | |
|---|---|
| Mg | >3.0–4.5, preferably 3.5–4.5 |
| Mn | 0.4–1.2, |
| Zn | 0.4–1.7, preferably 0.4–0.75 |
| Zr | 0.05–0.25 |
| Cr | 0.3 max. |
| Ti | 0.2 max. |
| V | 0.2 max. |
| Li | 0.5 max. |
| Sc | 0.5 max. |
| Fe | 0.5 max., such that preferably Fe/Mn ratio is 0.3–1.0 |
| Si | 0.5 max. |
| Cu | 0.15 max. |
| Ag | 0.4 max. |

balance Al and inevitable impurities.

However, neither in WO-97/38146, nor in WO-99/42627 it is mentioned or suggested that the aluminum wrought alloy could be successfully used as an aluminum casting alloy, in particular as an aluminum die-casting alloy.

It is believed that the improved properties available with the casting alloy of the invention, particularly higher strength levels and high elongation in combination with good casting characteristics, result from the combined additions of Mg, Mn and Zn in the given ranges. The aluminum casting alloy is therefore ideally suited for the improved post casting processing, i.e. the elimination of conventional high temperature solution heat treating and optionally ageing at room temperature or elevated temperature, while providing even complexly shaped die-cast products with improved dimensional stability and mechanical properties.

The reasons for the limitations of the alloying elements of the aluminum casting alloy according to the present invention are described below. All composition percentages are by weight.

Mg is the primary strengthening element in the alloy. Depending on the field of application, the magnesium content is preferably in the range of 2.7 to 6.0%. Mg levels below 2.7% do not provide the required strength and when the addition exceeds 6.0%, problems during casting occur. A more preferred minimum Mg level is 3.0%. The preferred level of Mg is 4.5 to 6.0%, more preferably 5.0 to 6.0%, and most preferably 5.2 to 5.8%, as a compromise between ease of casting, strength and corrosion resistance.

In another embodiment the Mg-level is in the range of 2.7 to 4.5%, and preferably 3.0 to 4.5%. In this range and in combination with the other alloying elements, the aluminum casting alloy is capable of obtaining in the as-cast condition a UTS of at least 210 MPa, a YS of at least 120 MPa, and an elongation of at least 17%, and in the best examples an elongation of 23% or more.

Mn is an essential additive element. In combination with Mg and Zn, Mn provides the strength in the as-cast condition and the welded joints of the alloy. Mn levels below 0.4% cannot provide sufficient strength and corrosion resistance to the alloy. Above 1.4% the castability becomes increasingly difficult. The preferred level of Mn is 0.45 to 1.2%, and more preferably 0.45 to 0.8%, which represents a balanced compromise between strength, corrosion resistance, and castability.

Zn is also an essential alloying element. In combination with Mg, Zn provides the strength in the as-cast condition and the welded joints of the alloy. Furthermore, the addition of Zn results in a good corrosion resistance of the aluminum cast alloy. Zn should be present in a range of 0.10 to 1.5%. At a level above 1.5% Zn the castability becomes increasingly difficult. A preferred range for Zn is 0.3 to 1.4%, more preferably 0.4 to 1.1%, and most preferably 0.45 to 0.9%, which represents a compromise between strength, corrosion resistance and castability. Usually Zn is considered in the art as an impurity element in AlMg casting alloys, which should be kept at a level as low as possible, preferably maximum of 0.10% and more preferably maximum of 0.05%. However, in the alloy according to the invention Zn may be present as an alloying element resulting in beneficial effects. Although not yet fully understood, it is believed that the addition of Zn contributes to the good casting characteristics of the alloy, such as a low tendency to die-sticking when used in a die-casting operation. Good results are being achieved in those examples having a Mg/Zn-ratio of 6.0 or more.

Zr is for achieving strength improvement in the cast product. Zr also improves the weldability of the cast product. Zr levels above 0.3% tend not to have any further advantages. The preferred level of Zr is in the range of 0.05 to 0.25%, and more preferably 0.06–0.16%.

V may be added for achieving further improvements in the mechanical properties of the cast product, in particular mechanical properties at elevated temperatures. If added, the preferred level of V is in the range of 0.05 to 0.25%, and more preferably in the range of 0.1 to 0.2%. The addition of V in the given range may in particular result in a further improved ductility of the alloy, in particular when heat treated following casting at a temperature in a range of 200 to 400° C.

Sc may be added to the alloy for improving the weldability of a cast product. The Sc may be added alone or in combination with Zr in a range of 0.05 to 0.25%. When Sc is added the resultant cast product should be heat treated preferably following the casting operation by holding the cast product at a temperature in a range of 250 to 400° C. for a holding time up to 10 hours. The Sc level should not exceed 0.3%, and is preferably in a range of 0.05 to 0.2%.

Further optional alloying element in the alloy according to the invention to improve specific properties can be up to 0.6% Cobalt alone or in combination with up to 0.6% Cerium, and Strontium up to 0.04%.

Ti is important as a grain refiner during solidification of both cast products and welded joint produced using the alloy of the invention. A preferred maximum for Ti addition is 0.2%, and where a more preferred range is of 0.01 to 0.14%.

Fe is a known element in aluminum casting alloys and may be present in a range up to 1.0%. At higher levels Fe may form undesirable large compounds with Mn in the holding furnaces typically employed in casting operations. When higher fracture toughness and/or ductility is desired a suitable maximum for the Fe content is 0.5%, and more preferably 0.3%, and most preferably 0.2%.

Si is a known impurity element in aluminum casting alloys, and normally should not be present a too high levels to avoid the loss in primary strengthening element Mg. However, in the present aluminum casting alloy it can be present is a range of up to 1.4%. Although at higher Si-levels the elongation is somewhat reduced, still very acceptable high levels of elongation in combination with high strength levels are obtained. In a preferred embodiment the Si level should not be more than 1.0%, and more preferably not more than 0.5%, and most preferably not more than 0.3%. A suitable minimum Si-level is 0.10%, and more preferably 0.15%.

Be may be added to AlMg casting alloys to prevent oxidation of the magnesium in the aluminum alloy, the amount added varying with the magnesium content of the alloy. As little as up to 0.005% causes a protective beryllium oxide film to form on the surface. Preferably, the Be level has a maximum of 0.005%, and more preferably is absent without deteriorating the properties of the cast product with this aluminum alloy.

The balance is aluminum and inevitable impurities. Typically each impurity is present at 0.05% maximum and the total of impurities is 0.25% maximum.

In an embodiment of the aluminum casting alloy according to the invention the alloy is capable of achieving in the as-cast condition a yield strength of more than 160 MPa, and in the best examples of more than 175 MPa, in combination with a tensile strength of more than 250 MPa, preferably more than 280 MPa, and in combination with an elongation of more than 10%, and in the best examples even more than 12%. By optimising the casting parameters, further improved tensile properties, and in particular in elongation, can be obtained. Furthermore, improvements in the mechanical properties of the alloy according to the invention can be obtained heat-treating a cast product as is conventional in the art. This further improvement is achieved at the expense of the loss of the earlier advantage that following casting no further heat treatments are required to achieve a desirable level of mechanical properties.

In another embodiment of the aluminum casting alloy according to the invention the alloy is capable of achieving in the as-cast condition a yield strength of more than 120 MPa, and in the best examples of more than 140 MPa, in combination with a tensile strength of more than 210 MPa, preferably more than 240 MPa, and in combination with an elongation of more than 17%, and in the best examples even more than 23%. By optimising the casting parameters, further improved tensile properties, and in particular in elongation, can be obtained. Furthermore, improvements in the mechanical properties of the alloy according to the invention can be obtained heat-treating a cast product as is conventional in the art. This further improvement is achieved at the expense of the loss of the earlier advantage that following casting no further heat treatments are required to achieve a desirable level of mechanical properties.

The aluminum-magnesium casting alloy in accordance with the invention may be processed by various casting techniques. For example, the alloy may be used with resin-bound sand cores and moulds. The best advantages are achieved when applied via permanent mould casting, die-casting, or squeeze casting. In particular when die-casting processes are applied, including vacuum die-casting processes, the best combination of desirable properties and castability characteristics is obtained. It is believed that by applying vacuum die-casting the weldability characteristics of the alloy according to the invention may be further improved. It is to be understood here that die-casting includes high-pressure die-casting operations.

In another aspect of the invention there is provided in a method of producing a cast aluminum product, preferably a die-cast product, comprising the aluminum alloy of the invention as set out above, and casting, preferably die-casting, a body of the aluminum alloy. Following the casting operation the (die-)cast body can be aged at a temperature in the range of 140 to 250° C. for a soaking time at this temperature in the range of 0.5 to 24 hours.

The invention will now be explained by reference to non-limiting examples.

EXAMPLE 1

On an industrial scale of casting two AlMg-alloys according to the invention, see Table 1, have been die-cast on a Mueller-Weingarten cold-chamber-die-casting machine with a locking pressure of 2 MN. The casting parameters varied comprised the preheat temperature of the die (130° C. and 210° C.) and the backpressure (500 and 900 bar). The die-cast product consisted of a plate having dimensions 100×150×2 mm.

From this die-cast plate three tensile specimens have been machined and subsequently tested in the as-cast condition. The mechanical properties in the as-cast condition averaged over three specimen tested have been listed in Table 2, where YS stands for 0.2% yield strength and UTS for ultimate tensile-strength. The elongation corresponds to the German norm A5. The AlMg-alloy according to the invention showed during the die-casting operation no tendency to die-sticking.

From the results in Table 2 it can be seen that the AlMg-alloy according to the invention results in very high tensile properties and high elongation in the as-cast condition. These surprisingly high properties are achieved without the need for further heat treatments. In particular the UTS and the elongation can be improved by increasing the backpressure in the casting operation. Smaller improvements in mechanical properties can be obtained by increasing the die-temperature. Further improvements can be expected by optimising the casting conditions, in particular by applying vacuum (high pressure) die-casting instead of conventional (high pressure) die-casting. From the results of alloy 2 it can be seen that having a high Si-level may result in a very acceptable elongation in combination with very high tensile strengths.

TABLE 1

| | Alloying and impurity elements, in wt. % | | | | | | | |
|---|---|---|---|---|---|---|---|---|
| Alloy | Si | Fe | Cu | Mn | Mg | Zn | Ti | Zr |
| 1 | 0.34 | 0.23 | 0.005 | 0.54 | 5.8 | 0.51 | 0.01 | 0.11 |
| 2 | 1.20 | 0.30 | 0.005 | 0.54 | 5.7 | 0.58 | 0.01 | 0.12 |

TABLE 2

| | Die-casting | Mechanical property as-cast condition | | |
|---|---|---|---|---|
| Alloy | parameter applied | YS [MPa] | UTS [MPa] | Elongation [%] |
| 1 | 130° C./500 bar | 172 | 276 | 7.3 |
| 1 | 210° C./500 bar | 168 | 278 | 8.3 |
| 1 | 130° C./900 bar | 171 | 301 | 13.0 |
| 1 | 210° C./900 bar | 170 | 305 | 14.2 |
| 2 | 130° C./500 bar | 178 | 293 | 7.0 |
| 2 | 210° C./500 bar | 181 | 288 | 7.0 |
| 2 | 130° C./900 bar | 185 | 312 | 11.1 |
| 2 | 210° C./900 bar | 188 | 313 | 9.2 |

EXAMPLE 2

On an industrial scale of casting four AlMg-alloys according to the invention, see Table 3, have been cast on a GDK-750 Mueller-Weingarten Vacural-cold-chamber-die-casting machine with a locking pressure of 8500 kN. The casting parameters comprised a preheat temperature of the die of 250° C. and a backpresssure of 500 bar. The vacuum die-cast products consisted of a plate having dimension 200×250×2 mm and 200×250×4 mm, hereinafter referred to as 2 mm and 4 mm plates respectively.

From each alloy six 2 mm or 4 mm plates have been cast. And from each die-cast plates a tensile specimen has been machined and subsequently tested in the as-cast condition. The mechanical properties in the as-cast condition averaged over six specimen tested have been listed in Table 4, where YS stands for 0.2% yield strength and UTS for ultimate tensile strength. The elongation corresponds to the German norm A5. The AlMg-alloy according to the invention showed during the die-casting operation no tendency to die-sticking.

From the results in Table 4 it can be seen that the AlMg-alloy according to the invention results in very high tensile properties and high elongation in the as-cast condition. From the results of Table 4 it can be seen that AlMg-alloys 2 and 3 having a fairly low Mg-level in combination with the Zn and Mn-levels, combine good strength levels with very high elongation. Except for the minor difference in Mg-content, alloys 2 and 3 have essentially the same composition. The difference in mechanical properties are believed to be due to the difference in plate thickness cast, it has been found that in the experiments carried out the 2 mm plates has somewhat more casting defects than the 4 mm plates. This difference can easily be overcome by further optimising the casting conditions. It is believed that alloys 2 and 3, independent of the plate thickness, are capable of obtaining a yield strength of 120 MPa or more, a tensile strength of 210 MPa or more, and an elongation of 20% or more. In the best examples an elongation of 27% has been measured.

TABLE 3

| | Alloying and impurity elements, in wt. % | | | | | | | |
|---|---|---|---|---|---|---|---|---|
| Alloy | Si | Fe | Cu | Mn | Mg | Zn | Ti | Zr |
| 1 | 0.20 | 0.27 | 0.03 | 0.47 | 4.9 | 0.47 | 0.01 | 0.12 |
| 2 | 0.18 | 0.26 | 0.04 | 0.57 | 3.5 | 0.41 | 0.01 | 0.13 |
| 3 | 0.20 | 0.28 | 0.04 | 0.51 | 3.2 | 0.42 | 0.01 | 0.13 |
| 4 | 0.26 | 0.26 | 0.04 | 0.53 | 5.0 | 0.62 | 0.01 | 0.12 |

TABLE 4

| | | Mechanical properties in the as-cast condition | | |
|---|---|---|---|---|
| Alloy | Plate thickness | YS [MPa] | UTS [MPa] | Elongation [%] |
| 1 | 4 mm | 137 | 259 | 13 |
| 2 | 2 mm | 128 | 247 | 17 |
| 3 | 4 mm | 114 | 247 | 23 |
| 4 | 2 mm | 149 | 279 | 15 |

EXAMPLE 3

The 2 mm vacuum die-cast product of Example 2 having the composition of Alloy no. 3 of Table 3 has been subjected also to a welding operation, during which in particular the development of porosity has been assessed.

Various welded joints have been made whereby the 2 mm die-cast plate was put on top of a 1.6 mm gauge AA6016A-wrought sheet such that an overlap was created (lap loint). At the overlap a weld was made by means of automated TIG welding, in a single pass and using 1.2 mm filler wire of AlSi12 (DIN 1732). Following welding the porosity in the welds has been determined using standard metallographic assessment techniques. An important criteria of a large European car manufacturer is that the level of porosity, as assessed by the square area occupied by the pores, must be 8% or less in order to qualify the weld as acceptable. Furthermore the pore size must be smaller then 0.5 times the thinnest welded sheet used, and only the pores that are larger then 0.05 mm should be taken into account.

In the welds using the die-cast alloy according to the invention the average porosity level was always in the range of 0.5 to 2.0%. No large pore sizes (>0.8 mm) have been found. This qualifies the die-casting alloy as being very good weldable.

Having now fully described the invention, it will be apparent to one of ordinary skill in the art that many changes and modifications can be made without departing from the spirit or scope of the invention as set forth by the claims appended hereto.

What is claimed is:

1. A cast product of an aluminum-magnesium casting alloy consisting of, in weight percent:

| | |
|---|---|
| Mg | 3.0–4.5 |
| Mn | 0.4–1.4 |
| Zn | 0.4–0.9 |
| Zr | 0.05 to 0.25% |
| V | 0.3 max. |
| Sc | 0.3 max. |
| Ti | 0.2 max. |
| Fe | 1.0 max. |
| Si | 1.4 max. |
| impurities | each 0.05 max.<br>total 0.25 max. |

balance aluminum, wherein the product is a die-cast product and the aluminum casting alloy is a die-casting alloy and said die-cast aluminum alloy product in the as-cast condition has an elongation of at least 10%.

2. An aluminum casting alloy cast product according to claim 1, wherein the Fe content is in the range of at most 0.5%.

3. An aluminum casting alloy cast product according to claim 1, wherein the Mn content is in the range of 0.4 to 1.2%.

4. An aluminum casting alloy cast product according to claim 1, wherein the die-cast aluminum alloy product in the as-cast condition has a UTS of at least 250 MPa, a YS of at least 160 MPa, and an elongation of at least 10%.

5. An aluminum alloy cast product according to claim 1, wherein the die-cast aluminum alloy product in the as-cast condition has a UTS of at least 210 MPa, a YS of at least 120 MPa, and an elongation of at least 17%.

6. An aluminum casting alloy cast product according to claim 1, wherein the Zn content is in the range of 0.45 to 0.9%.

7. The aluminum casting alloy cast product according to claim 1, wherein the die-cast product is a safety component of a vehicle.

8. The aluminum casting alloy cast product according to claim 1, wherein the die-cast product is a frame member for a vehicle.

9. An aluminum casting alloy cast product according to claim 1, wherein the Si content is 1.0% max.

10. An aluminum casting alloy cast product according to claim 1, wherein the Si content is 0.5% max.

11. An aluminum casting alloy cast product according to claim 1, wherein the Si content is 0.3% max.

12. An aluminum casting alloy cast product according to claim 1, wherein the Si content is in the range of 0.10 to 1.4%.

13. An aluminum casting alloy cast product according to claim 1, wherein the Si content is in the range of 0.15 to 1.4%.

14. An aluminum casting alloy cast product according to claim 1, wherein the Mn content is in the range of 0.4 to 0.8%.

15. An aluminum casting alloy cast product according to claim 1, wherein the Zr content is in the range of 0.06 to 0.16%.

16. An aluminum casting alloy cast product according to claim 1, wherein the Ti content is in the range of 0.01 to 0.14%.

17. An aluminum casting alloy cast product according to claim 1, wherein the alloy has a Mg/Zn weight ratio of at least 6.0.

18. An aluminum casting alloy cast product according to claim 1, wherein the Zn content is in the range of 0.41 to 0.9%.

19. An aluminum casting alloy cast product according to claim 1, wherein the Zn content is in the range of 0.42 to 0.9%.

20. An aluminum casting alloy cast product according to claim 1, wherein the Zn content is in the range of 0.47 to 0.9%.

21. An aluminum casting alloy cast product according to claim 1, wherein the Mg content is in the range of 3.2 to 3.5%.

22. An aluminum casting alloy cast product according to claim 1, wherein the Mg content is between 3.0 and 4.5%.

23. An aluminum casting alloy cast product according to claim 1, wherein the product is in a shape for a product selected from the group consisting of vehicle wheels, steering wheel, steering column, airbag module/can, brake drum.

24. An aluminum alloy cast product according to claim 1, wherein the die-cast aluminum alloy product in the as-cast condition has an elongation of at least 17%.

25. A method of use of an aluminum alloy comprising die casting the alloy of claim 1.

26. The method according to claim 25, wherein the casting is die-casting of safety components for a vehicle.

27. The method according to claim 17, wherein the casting is die-casting of a frame member for a vehicle.

* * * * *